United States Patent [19]

Eskina

[11] Patent Number: 4,531,741

[45] Date of Patent: Jul. 30, 1985

[54] PUZZLE

[76] Inventor: David A. Eskina, 929 SW 11th, Moore, Okla. 73160

[21] Appl. No.: 625,132

[22] Filed: Jun. 27, 1984

[51] Int. Cl.[3] ..... A63F 9/10
[52] U.S. Cl. ..... 273/157 R
[58] Field of Search ..... 273/157 R

[56] References Cited

FOREIGN PATENT DOCUMENTS

| | | | |
|---|---|---|---|
| 953120 | 5/1949 | France | 273/157 R |
| 1525 | 11/1889 | Switzerland | 273/157 R |
| 4537 | of 1905 | United Kingdom | 273/157 R |

*Primary Examiner*—Anton O. Oechsle
*Attorney, Agent, or Firm*—William R. Laney

[57] ABSTRACT

A puzzle which includes five interfitting pieces, four of which can be interfitted to collectively form a square and all five of which can be interfitted to collectively form a larger square.

1 Claim, 3 Drawing Figures

PUZZLE

BACKGROUND OF THE INVENTION

1. Field of the Invention

This invention relates to puzzles which include a multiplicity of interfitting pieces which can be laid upon a flat surface and, when interfitted, form a geometric figure.

2. Brief Description of the Prior Art

Luton U.S. Pat. No. 2,394,864 discloses a relatively simple child's puzzle of interlocking pieces. In the case of the Luton puzzle, four pieces are used and they can be arranged in one way relative to each other to form a square, or can be rearranged in another way to form a rectangle.

Other patents which are directed to various types of puzzles made by interfitting pieces laid flat upon a supporting surface include U.S. Pat. No. D. 262,389 to Bogne; U.S. Pat. No. D. 265,919 to Spiecker; and Benedict U.S. Pat. No. 1,271,997. In the Benedict patent, five pieces are provided which, when interfitted in one way, form a square, and when interfitted in a different way, form a triangle. Berry U.S. Pat. No. 4,365,809 is a nine-piece puzzle, the pieces of which can be alternatively assembled into either a rectangle, a square or a five-pointed star.

None of the described puzzles contemplates the provision of a puzzle where four pieces can be interfitted to form a relatively small square and a fifth piece can be used with these four pieces to alternatively form a larger square.

GENERAL DESCRIPTION OF THE PRESENT INVENTION

The present invention is a simple child's puzzle which includes five pieces. When four of these pieces are fitted together correctly, the pieces form a square. The fifth piece can then be interfitted with the five pieces used to form the first square in an arrangement where the four pieces used in forming the first square interfit in a different pattern, and interfit with the fifth piece to collectively form a square of larger dimensions than the first four-piece square.

An important object of the invention is to provide a puzzle which is very inexpensive to manufacture, and which is sufficiently difficult to provide a challenge to small children to successfully work the puzzle.

Another object of the invention is to provide a puzzle in which the objective is to use a part of the pieces so that, when interfitted, less than all of the pieces of the puzzle will form a geometric square, and then, using all of these same pieces, and one or more additional pieces, will together form another square of larger dimensions.

These and other objects of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EBODIMENT OF THE INVENTION

Figure 1:
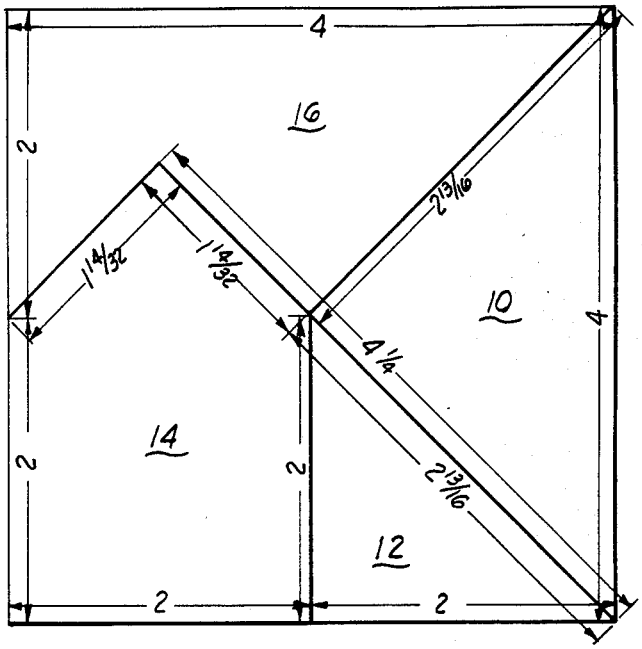
FIG. 1 is a plan view of the puzzle when it has been worked to use four pieces of the puzzle to make a square.

Referring initially to FIG. 1 of the drawings, four pieces of a puzzle are there illustrated and include one piece 10 which is an isosceles triangle in configuration and has two equal sides which are 2-13/16 inches in length and a base which is 4 inches in length. The four pieces also include a second triangular piece 12 having a base 2-13/16 inches in length and two equal sides which are 2 inches in length. A third piece 14 includes two parallel sides each of which is 2 inches in length, a base which is 2 inches in length and extends normal to the 2-inch sides, and a pair of convergent sides opposite the base, each of which is 1-14/32 inches in length and which intersect in a right angle. In other words, the piece 14 may be thought of as a single piece made up of a square having each of its sides 2 inches in length surmounted by a joined or integrated isosceles right triangle, the base of which is 2 inches in length and coincides with one side of the square, and whose two sides of equal length are each 1-14/32 inches in length.

The fourth piece 16 is a piece of irregular shape, but which, when interfitted against the piece 14 and the piece 10 will, with those two pieces and the piece 12, form a square having four 4-inch sides. The fourth piece 16 thus includes a base or long side 4 inches in length, a pair of angulated sides which are 114/32 inches in length and which converge to define a right angle, and a side of 2-13/16 inches in length which intersects one of the sides of 1-14/32 inch length at a right angle. The piece 16 has a fifth side which is 2 inches in length and which extends normal to the longest side which is 4 inches in length.

Figure 2:
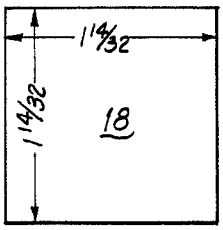
FIG. 2 is a plan view of a fifth piece of the puzzle not used when the puzzle is assembled as shown in FIG. 1.
Figure 3:
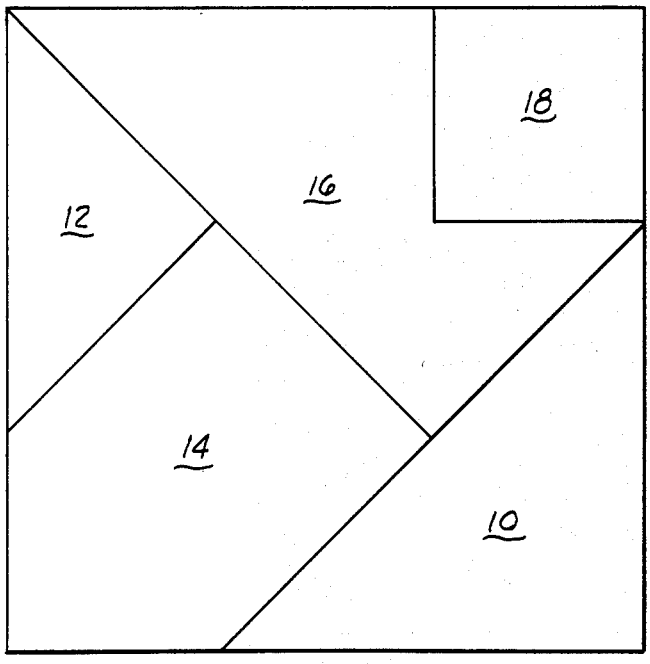
FIG. 3 is a plan view of the puzzle in which the fifth piece, shown in FIG. 2, has been used with the four pieces employed in the arrangement shown in FIG. 1 to make another and larger square when all five pieces are interfitted together.

There is, in addition to the four pieces 10–16, a fifth piece to the puzzle which is shown in FIG. 2, and is there denominated by reference numeral 18. The fifth piece 18 is a square having sides which are each 1-14/32 inches in length. This configuration of the fifth piece 18 permits it to be interfitted with the other four pieces in the manner shown in FIG. 3 to form a larger square, the sides of which are each $4\frac{1}{4}$ inches in length. It will be noted that when the five pieces are interfitted to make the larger square as shown in FIG. 3, the largest isosceles triangle occupies one corner of the square, the smaller isosceles triangle has one of its corners at one corner of the square, and the small square constituted by piece 18 is located at a third corner of the square.

The puzzle described is an interesting device which captures the attention of small children and challenges them to solve the puzzle, once it is explained that all five pieces can be utilized in some combinations to make two perfect squares, one of which is smaller than the other.

Although a preferred embodiment of the invention has been herein described, it will be understood that various changes can be made in the illustrated structure without departure from the basic principles of the invention. Thus, the actual sizes of each of the pieces can be scaled up, so long as the ratios of the sides to each other remain the same. Changes and innovations of this type are deemed to be circumscribed by the spirit and scope of the invention, except as the same may be necessarily limited by the appended claims or reasonable equivalents thereof.

What is claimed is:

1. A puzzle having five interlocking pieces which can be interfitted to form a square, and which include a square piece and four pieces which can be interfitted to form a second square of smaller area then said first-mentioned square, said four pieces including two isosceles triangular-shaped pieces and a five-sided third piece having two parallel sides of equal length, a third side equal in length to the two parallel sides and extending normal to the two parallel sides, and fourth and fifth sides extending normal to each other.

* * * * *